US005492381A

United States Patent [19]

Waters

[11] Patent Number: 5,492,381

[45] Date of Patent: Feb. 20, 1996

[54] RETRACTABLE DOOR OR WINDOW STOP

[75] Inventor: James S. Waters, Port Melbourne, Australia

[73] Assignee: Steplock Pty Ltd., Albert Park, Australia

[21] Appl. No.: 305,043

[22] Filed: Sep. 13, 1994

Related U.S. Application Data

[63] Continuation-in-part of Ser. No. 952,851, Jan. 15, 1993, abandoned.

[30] Foreign Application Priority Data

May 24, 1990 [GB] United Kingdom ..... 9011668

[51] Int. Cl.[6] ..... F05C 17/44

[52] U.S. Cl. ..... 292/338; 292/229; 292/DIG. 15

[58] Field of Search ..... 292/338, 229, 292/69, DIG. 15, 342, DIG. 47, 194, 1, DIG. 19, DIG. 44

[56] References Cited

U.S. PATENT DOCUMENTS

| | | |
|---|---|---|
| 614,741 | 11/1898 | Moore, Jr. . |
| 3,141,188 | 7/1964 | Gray . |
| 3,737,186 | 6/1973 | Chezem . |
| 4,348,879 | 9/1982 | Knierim . |
| 4,552,395 | 11/1985 | Dominguez . |

FOREIGN PATENT DOCUMENTS

| | | |
|---|---|---|
| 4572/26 | 11/1926 | Australia . |
| 409978 | 5/1910 | France . |
| 487959 | 8/1918 | France . |
| 1007932 | 2/1952 | France ..... 292/1 |
| 72916 | 6/1898 | Germany . |
| 141166 | 4/1920 | United Kingdom . |
| 2190136 | 11/1967 | United Kingdom . |
| 2166489 | 5/1986 | United Kingdom . |

*Primary Examiner*—Rodney M. Lindsey
*Attorney, Agent, or Firm*—Merchant, Gould, Smith, Edell, Welter & Schmidt

[57] ABSTRACT

A retractable door or window stop member includes a barrel which defines a recess in a top surface. A spigot is pivotable about a first axis extending transversely of the recess. An adjustment means enables the spigot to be pivoted between its first and second positions. A spring means is in the recess and acts between the spigot and the barrel to urge the spigot to and thereby tending to positively retain the spigot in its first position. The spring means is secured in relation to the barrel between the first axis and the second axis at each of the opposite sides of the recess, the spring means having an intermediate position which extends towards the first axis and which engages a protrusion on the underside of the spigot to thereby urge the spigot to its first position. The stop member includes a stop means included in the barrel to define a limit to movement of the spigot to its second position, the stop means being positioned to stop movement of the slidable pivot away from the first axis when the spigot reaches its second position.

4 Claims, 2 Drawing Sheets

RETRACTABLE DOOR OR WINDOW STOP

This application is a Continuation-in-Part of U.S. Ser. No. 07/952,851, filed on Jan. 15, 1992 now abandoned.

BACKGROUND OF THE INVENTION

The invention relates to a door or window stop and inventive improvement to the stop shown in published United Kingdom patent specification number 2,190,136. This published specification and the prior specification number 2,166,489 brought forward against it by the United Kingdom Patent Office in their preliminary examination and search of it, constitutes the most relevant art known to the applicant.

Each of these prior specifications discloses a door or window stop, intended in use to hold shut an inward opening door and/or to allow the door to be opened to only a limited extent, whilst also being retractable to allow the door to be fully opened and closed without hindrance; and comprising in combination the following feature:

(a) a barrel which, in use, is screwed or otherwise fixed to the floor or the wall reveal adjacent the closing edge of the door or window and inside the room or other area to which the door or window gives access;

(b) a spigot which, when in a first position, protrudes from the barrel to bear against or adjacent a surface of the door or window and which is retractable into a second position into the barrel so as not to impede the passage of the door or window edge;

(c) means enabling the spigot to be moved alternately into its protruding and its retraced positions by a user's hand or foot;

(d) means tending positively to retain the spigot in its protruding position, once the spigot has been moved into that position;

(e) the spigot comprising a substantially flat bar, and the means enabling the spigot to be moved into and out of its protruding position including a pivot linking one end of the bar to the barrel so that the bar swings about the pivot into and out of the barrel;

(f) stop means included in the barrel to define the limit of movement of the bar into its protruding position.

Such a stop will be referred to from now on as a stop "of the kind in question".

SUMMARY OF THE INVENTION

The stops, of the kind in question, that are disclosed in both the prior United Kingdom patent specifications listed above, are stops in which there is no means urging the bar into its non-protruding retracted-into-the-barrel position. They rely on the force of gravity, operating in conjunction with a sufficiently friction-free ease of relative movement of the stop pans, to send the bar fully home to that position. There is a risk in such circumstances that the bar might stick in a partly-protruding position.

According to the present invention, in its broadest aspect, there is provided a stop member, for use with a closure member comprising a door or window, the stop member including:

(a) a barrel which, in use, is secured to a floor or wall reveal adjacent to a closing edge of the closure member at a location towards which the closure member is openable to give access therethrough, the barrel defining a recess in a top surface thereof;

(b) a spigot comprising a substantially flat bar which is pivotally secured at one end thereof in said recess so as to be pivotable, about a first axis extending transversely of the recess, between a first position within the barrel and a second position in which it projects from the barrel;

(c) adjustment means enabling the spigot to be pivoted between its first and second positions by a user's hand or foot, the adjustment means comprising a tongue pivotally connected at one end thereof to the barrel so as to be pivotable about a second axis, the tongue being pivotally connected adjacent to its other end to the other end of the spigot so as to be pivotable relative to the spigot about a third axis, the second axis and third axis each being substantially parallel to the first axis, and the second axis being defined by a pivot which is slidable along the recess towards and away from the first axis such that the tongue is within the barrel when the spigot is in its first position and such that, with the spigot in its second position, the tongue projects from the barrel and acts to hold the spigot in its second position;

(d) spring means in the recess and acting between the spigot and the barrel to urge the spigot to and thereby tending to positively retain the spigot in its first position, the spring means being secured in relation to the barrel between the first axis and the second axis at each of opposite sides of the recess, the spring means having an intermediate portion which extends towards the first axis and which engages a protrusion on the underside of the spigot to thereby urge the spigot to ifs first position; and (e) stop means included in the barrel to define a limit to movement of the spigot to its second position, the stop means being positioned to stop movement of the slidable pivot away from the first axis when the spigot reaches its second position;

wherein, with the stop member secured to a floor or wall reveal at said location and with the spigot held in its second position by the tongue, the stop member is operable to limit opening of the closure member beyond that location, but with the stop member enabling the closure member to be fully opened or closed without hindrance when the spigot is in the first position.

Since the stops shown in specification 2,116,489 and 2,190,136 have sold, and been used satisfactorily, in quantity, it is not immediately apparent that there is any need for any such bar-urging means. Even after that realisation, the conventional way to incorporate such a spring means would be by way of a torsion spring on the bar pivot. Doing it in the way required by the invention, by contrast, has the twin advantages of giving a far neater appearance to the stop whilst making the bar-retracting movement more positive to minimise the risk of partial sticking-open.

Advantageously the spring means acts on a protrusion formed on the underside of the bar. The protrusion could project from an otherwise substantially flat underside surface of the bar or it could effectively be formed by grooving or otherwise forming a channel in the underside of the bar, one sidewall of the channel then constituting the protrusion.

Preferably the spring means is an elongate spring whose longitudinal axis runs across the longitudinal axis of the bar and whose opposite ends are trapped between respective opposite side members of the said portion of the barrel into which the spring retracts; with a portion of the spring intermediate its ends acting on the underside of the bar. It is technically difficult to incorporate any spring means into the barrel whilst keeping it effectively hidden from view and this is a particularly neat way of doing it.

In the case just outlined, the spring is conveniently a coiled spring, again for reasons of technically efficiency combined with ease of insertion and positive subsequent retention in the barrel. The spring could be a leaf spring. But it could also be constituted by a coiled-rod form of spring and this is a currently preferred embodiment.

The invention includes within its scope a door or window stop substantially as described herein with reference to and as illustrated in the accompanying drawings. One such stop will now be described with reference to the drawings.

BRIEF DESCRIPTION OF THE DRAWINGS

An example of a stop in accordance with the invention will now be described, by way of example only, with reference to the accompanying drawings in which:

FIG. 6 is a perspective view of the stop.

DESCRIPTION OF THE PREFERRED EMBODIMENT

Figure 4:
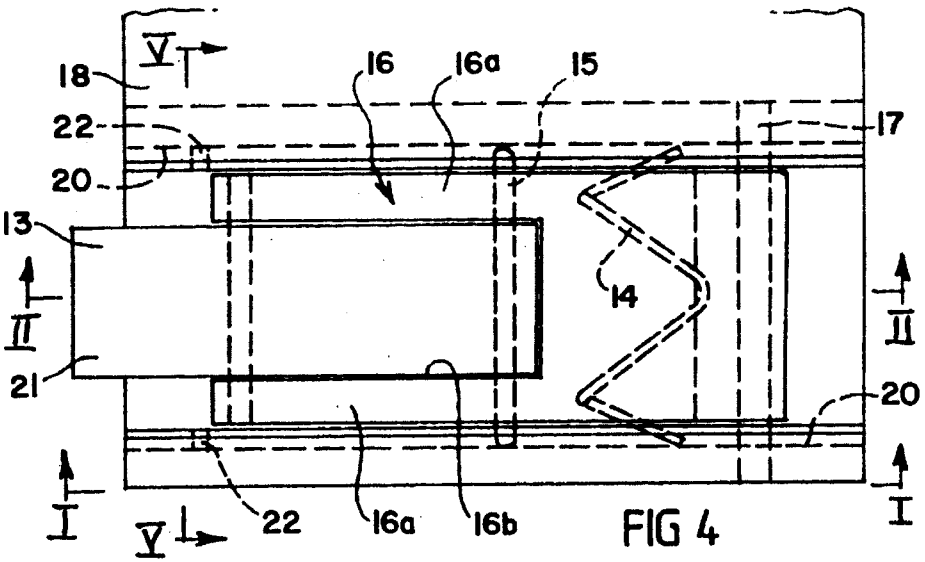
FIG. 4 is a plan view of the stop showing the position of the spring.

The drawing shows a stop 10 which is intended, when open in use, to limit the movement of a window or door. The stop 10 is also retractable to allow the door or window to be fully opened or closed without hindrance.

Figure 1:
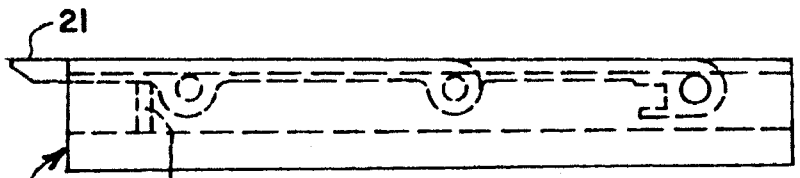
FIG. 1 is a longitudinal side elevation of the stop when closed, taken on line I—I of FIG. 4.

Referring to FIG. 1, the stop 10 comprises a barrel 11 having a body 11*a* which is generally cuboid in shape and has only a small depth to allow it to be set within a recess in a floor or wall reveal.

The barrel 11 also includes a flange 18 which is integral with, and projects laterally from, the body 11*a*. When body 11*a* is set within a recess in a floor or wall reveal, the top surface of flange 18 is flush with the floor or wall reveal.

The body 10*a* of the barrel 11 includes a recess 12 in which a spigot 16, a spring 14 and a tongue 13 are mounted.

Figure 5:
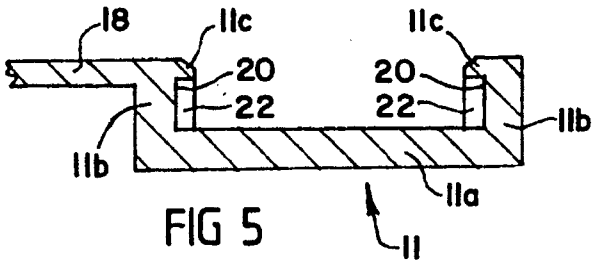
FIG. 5 is a longitudinal section through the barrel of the stop.

The recess 12 opens at the top of the body 11*a* such that, in transverse cross-section, the body 11*a* is of shallow channel form as is evident from FIG. 5. The body 11*a* has respective side walls 11*b*, each defining an inwardly projecting lip 11*c*, such that a respective channel 20 is defined along each side of recess 12.

The spigot 16 is of elongate form and is pivotally mounted at one end thereof in recess 12. The mounting of spigot 16 is by means of a pivot pin 17, which is journalled in each side wall 11*b* of body 11*a*, adjacent to one end of recess 12. The spigot 16 is bifurcated over a major pad of its length from the end thereof remote from pivot pin 17. The bifurcation is such that spigot 16 defines substantially parallel side arms 16*a* spaced by a rectangular U-shaped bight 16*b*.

Tongue 13 also is of elongate form, while it has a width slightly less than the spacing across bight 16*b*, between arms 16*a* of spigot 16. Tongue 13 is pivotally mounted at one end thereof in recess 12 by pivot pin 15, with the latter having each of its ends located in a respective channel 20. The arrangement is such that pin 15 and, hence, the location of the pivotal mounting of tongue 13 in recess 12, is slidable along recess 12 towards and away from pivot pin 17. Towards its end remove from pin 15, tongue 13 is pivotally mounted between the ends of arms 16*a* of spigot 16, by a pivot pin 15*a* which is journalled in arms 16*a*. The length of tongue 13, between pivot pins 15 and 15*a* is slightly less than the length of arms 16*a*, between pivot pin 15*a* and the inner extent of bight 16*b*.

Figure 2:
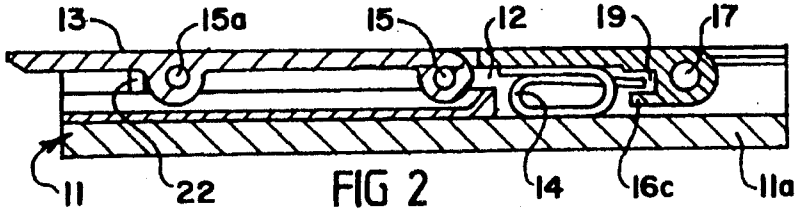
FIG. 2 is a longitudinal sectional view of the stop when closed, taken on line II—II of FIG. 4.
Figure 3:
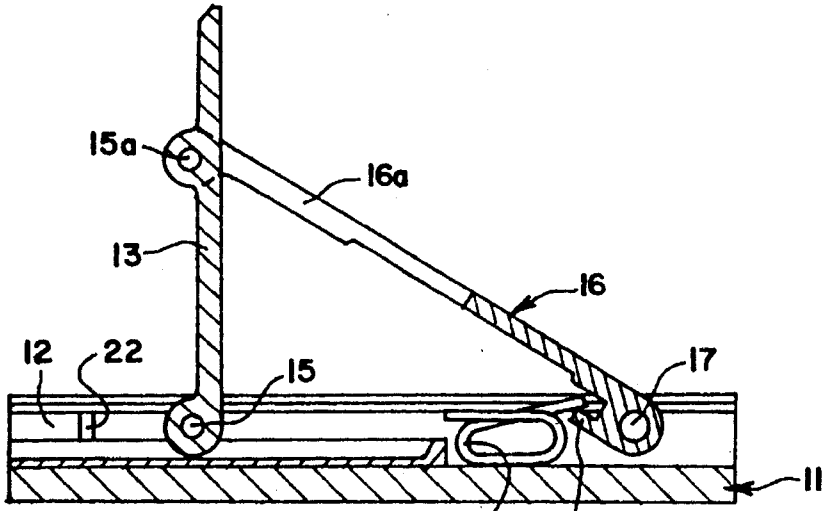
FIG. 3 is a longitudinal sectional view corresponding to FIG. 2, but showing the stop when open.
Figure 6:
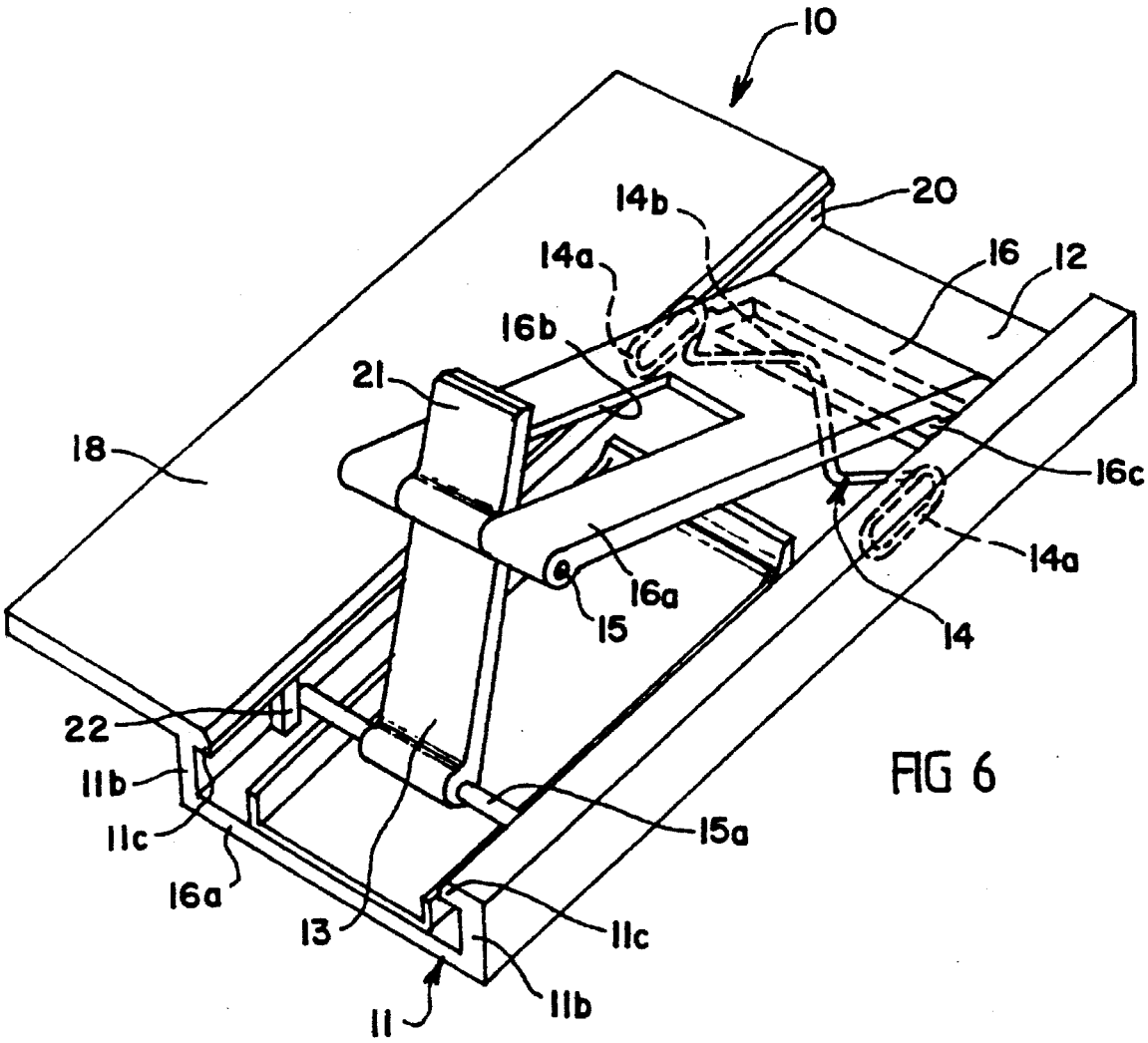
FIG. 6 is a perspective view of the stop when fully open.

Referring now to FIGS. 2 and 3, the spigot 16 is movable between a first and a second position. In movement towards the first position, such as shown in FIG. 3, the spigot 16 protrudes from the barrel 11 to bear against or adjacent a surface of the door or window. When the spigot 16 is retracted into its second position, as shown in FIG. 2, it is within the barrel 11 so as not to impede the passage of the door or window edge. The tongue 13 comprises a substantially fiat bar and the means enabling the tongue to be moved into and out of its protruding position includes pin 15 which provides a pivot giving a tongue pivotal axis about which the tongue 13 can be swung into and out of the barrel 11, and pin 15*a* which causes movement of the spigot 16 in response to pivoting of the tongue 13 on the pin 15*a*.

In the retracted position, shown in FIGS. 2 and 4, the tongue 13 lies parallel to the surface of the spigot 16, so that the flange 18, which is attached to the floor or wall reveal, barrel 11, spigot 16 and tongue 13 present a flat surface over which a window or door may pass. A coiled torsion spring 14 acts between one side wall of a channel 19 formed in the spigot 16. Each opposite ends of the spring 14 is trapped in a respective U-shaped channel 20 within the barrel 11, to each side of the spigot 16. The spring 14 will tend to urge the spigot 16 to remain in its retracted position, parallel with the flange 18, the barrel 11 and the tongue 13.

The tongue 13 has an end 21 forming a handle which conveniently provides means by which the tongue 13 enables the spigot 16 to be moved into and out of its protruding position.

As shown most clearly in FIG. 2, end 21 of the tongue 13 protrudes beyond pivot pin 15*a*, away from pivot pin 15, so as to project beyond the end of recess 12 remote from pivot pin 17 when the spigot 16 is in its retracted position. To move the spigot 16 to its protruding position, end 21 of the tongue 13 is raised, so as to be pivoted on the pin 15. As a consequence of pivot pin 15*a*, the spigot 16 also is raised towards its protruding position, by pivoting on pin 17 against the bias of the spring 14, with pivot pin 15 being drawn along recess 12 away from pin 17. When the spigot 16 is in its protruding position, further movement of pin 15 away from pin 17 is prevented by a stop means 22, with the tongue 13 then being in an over-centre position for providing a bracing action preventing the bias of the spring 14 from unintentionally returning the spigot 16 to its retracted position. For the spigot 16 to return to its retracted position, it is necessary for the end 21 of the tongue 13 to be pushed back from its over-centre position, away from pin 17, to enable the spring 14 to bias the spigot 16 back towards and into recess 12.

The stop means 22 is shown as comprising a respective abutment provided in each channel 20, for engaging an end of pin 15. However, any suitable abutment positioned in recess 12 so as to engage pin 15 or the associated end of the tongue 13, when the latter is in its over-centre position, can be provided.

The spring 14, comprising a coiled tension spring, extends across the width of recess 12, intermediate the pins 15 and 17. A respective end coil 14*a* of the spring 14 is securely engaged in each side channel 20 of the recess 12, while a central spring section 14*b* of the spring 14 projects towards and locates in the channel 19 of the spigot 16. The channel 19 is defined by a lip 16*c* which is defined by the underside of the spigot 16, adjacent to the pin 17; with the lip 16*c* providing the means by which the spring 14 applies a biasing force acting to urge the spigot 16 to its retracted position. However, as indicated above, the spring means could alternatively be a similarly located and similarly acting leaf spring.

As can be seen, stop 10 is able to be operated easily. It can be used in many different positions to act as a stop to hold a door either open or closed or partially opened or closed. It can also be used to define a limit position of movement of a window to provide a lock on, for example, a sash window which can easily be retracted to allow smooth movement of a door or window.

It will be appreciated that the stop 10 may equally be made from any suitable nylon, plastics or non-ferrous materials.

it will be further appreciated that the stop 10 can be used in many other situations than with doom and windows since it can be used wherever a retractable stop is required.

I claim:

1. A stop member, for use with a closure member comprising a door or window, the stop member including:

(a) a barrel which, in use, is secured to a floor or wall reveal adjacent to a closing edge of the closure member at a location towards which the closure member is openable to give access therethrough, the barrel defining a recess in a top surface thereof;

(b) a spigot comprising a substantially flat bar which is pivotally secured at one end thereof in said recess so as to be pivotable, about a first axis extending transversely of the recess, between a first position within the barrel and a second position in which it projects from the barrel;

(c) adjustment means enabling the spigot to be pivoted between its first and second positions by a user's hand or foot, the adjustment means comprising a tongue pivotally connected at one end thereof to the barrel so as to be pivotable about a second axis, the tongue being pivotally connected adjacent to its other end to the other end of the spigot so as to be pivotable relative to the spigot about a third axis, the second axis and third axis each being substantially parallel to the first axis, and the second axis being defined by a pivot which is slidable along the recess towards and away from the first axis such that the tongue is within the barrel when the spigot is in its first position and such that, with the spigot in its second position, the tongue projects from the barrel and acts to hold the spigot in Its second position;

(d) spring means in the recess and acting between the spigot and the barrel to urge the spigot to and thereby tending to positively retain the spigot in its first position, the spring means being secured in relation to the barrel between the first axis and the second axis at each of opposite sides of the recess, the spring means having an intermediate portion which extends towards the first axis and which engages a protrusion on the underside of the spigot to thereby urge the spigot to its first position; and (e) stop means included in the barrel to define a limit to movement of the spigot to its second position, the stop means being positioned to stop movement of the slidable pivot away from the first axis when the spigot reaches its second position;

wherein, with the stop member secured to a floor or wall reveal at said location and with the spigot held in its second position by the tongue, the stop member is operable to limit opening of the closure member beyond that location, but with the stop member enabling the closure member to be fully opened or closed without hindrance when the spigot is in the first position.

2. A stop according to claim 1, the spring means is an elongate spring having an axis which extends transversely of the recess with each of opposite ends of the spring trapped in a respective opposite side member of the barrel, a portion of the spring intermediate its ends engaging and acting on said protrusion.

3. A stop according to claim 2, wherein the spring is a coiled spring.

4. A stop according to claim 3, wherein the spring is of coiled-rod form.

* * * * *